United States Patent [19]

Hunsucker

[11] Patent Number: 4,531,471

[45] Date of Patent: Jul. 30, 1985

[54] ROLL RESTRAINT OF ANCHORED VESSEL

[76] Inventor: William A. Hunsucker, 3741 Prestwick Dr., Los Angeles, Calif. 90027

[21] Appl. No.: 537,430

[22] Filed: Sep. 29, 1983

Related U.S. Application Data

[63] Continuation of Ser. No. 396,633, Jul. 9, 1982, abandoned.

[51] Int. Cl.[3] ..... B63B 21/50

[52] U.S. Cl. ..... 114/293

[58] Field of Search ..... 114/293, 294, 230, 264, 114/265

[56] References Cited

U.S. PATENT DOCUMENTS

| | | | |
|---|---|---|---|
| 3,031,997 | 5/1962 | Nesbitt | 114/293 |
| 3,080,583 | 3/1963 | Fuller | 114/264 |
| 3,151,594 | 10/1964 | Collipp | 114/293 |
| 3,369,511 | 2/1968 | German | 114/293 |
| 3,552,343 | 1/1971 | Scott | 114/230 X |
| 3,583,354 | 6/1971 | Flickinger | 114/293 |
| 4,033,277 | 7/1977 | Schaper | 114/293 |

FOREIGN PATENT DOCUMENTS

| | | | |
|---|---|---|---|
| 2343643 | 10/1977 | France | 114/294 |

*Primary Examiner*—Sherman D. Basinger
*Attorney, Agent, or Firm*—William W. Haefliger

[57] ABSTRACT

A floating vessel has an upper portion with heavy equipment (such as drilling equipment, for example) mounted thereon. Also provided are:

(a) a structure for anchoring the vessel at a selected site on a body of water, (b) such structure including anchor lines effectively attached to the vessel and also extending away from the vessel to transfer loading to the vessel at upper and lower locations associated with the vessel and spaced from the vessel center characterized in that tilting of the vessel is resisted by such lines.

23 Claims, 16 Drawing Figures

FIG. 1.
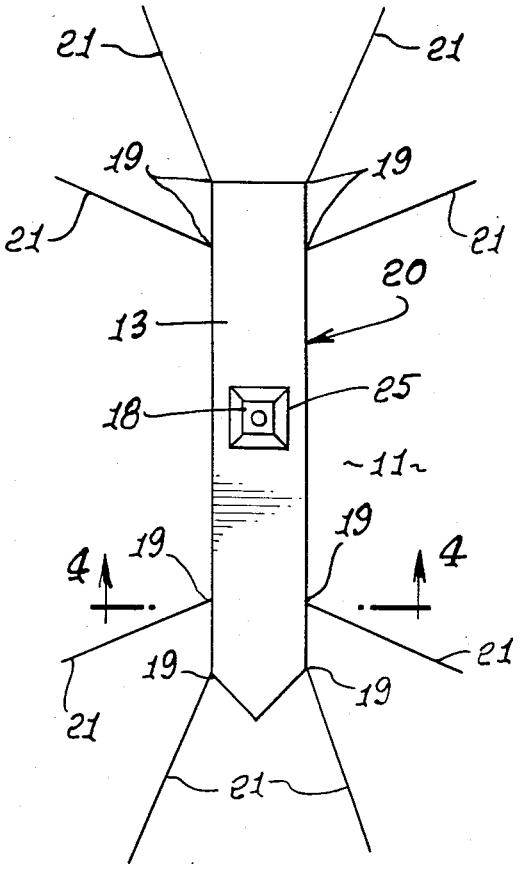
FIG. 2.
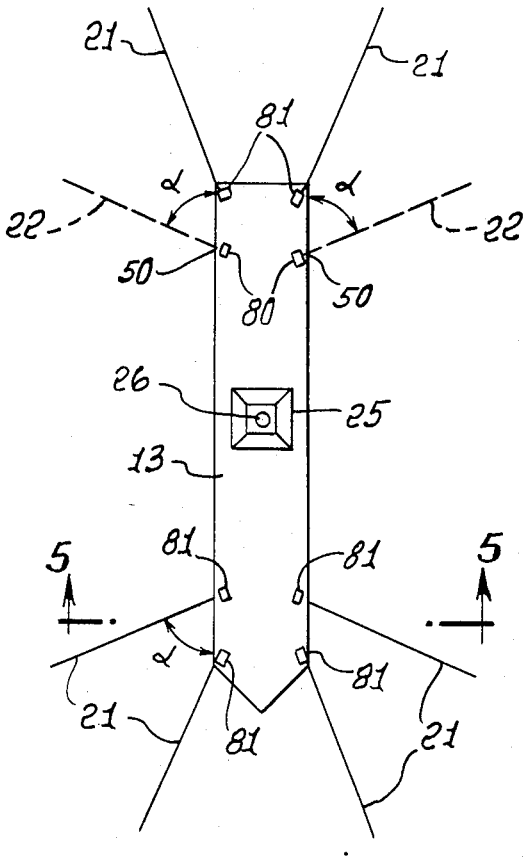
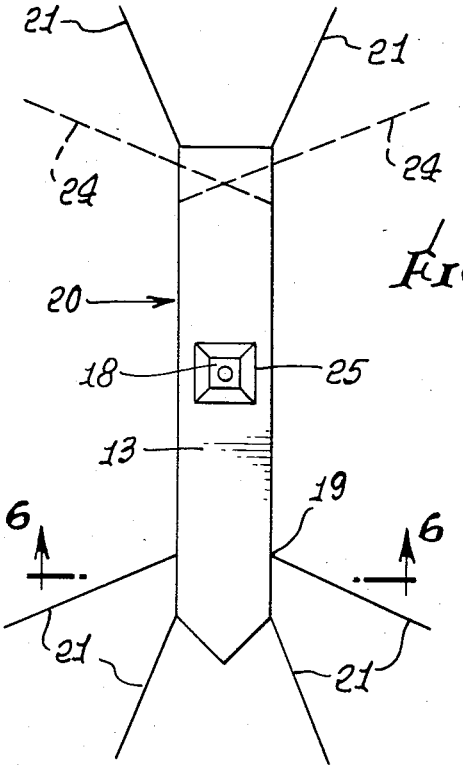
FIG. 3.

ROLL RESTRAINT OF ANCHORED VESSEL

This is continuation of application Ser. No. 396,633, filed July 9, 1982 now abandoned.

BACKGROUND OF THE INVENTION

This invention relates generally to apparatus for supporting heavy loads in or over a body of water, and more particularly concerns minimizing the rolling motion of a buoyant support for marine drilling, salvage or construction operations. The invention will be described in connection with marine drilling operations, although this is primarily by way of illustration.

Where buoyant members are used to support a derrick and derrick floor for drilling operations over a body of water, it is conventional to mount the derrick and derrick floor on a ship-shaped hull, commonly called a drill ship. The drill ship is typically located at a selected drill site, and usually will be anchored in place by means of a plurality of wire ropes, anchor chains or a combination of wire ropes and anchor chains attached to suitable anchors. These anchoring means are commonly referred to as anchor lines.

The longitudinal axis of the drill ship will normally be oriented as to be parallel to the direction of the prevailing winds as nearly as this can be determined; however, during adverse weather, some component of the wind and wave forces will usually be applied on the drill ship in a direction parallel to the transverse axis of the drill ship. As a result, such component or components of the wind forces and the related wave forces induce rolling motion of the drill ship, about a longitudinal axis thereof. Such rolling motion is detrimental to a drilling operation being conducted due to the relative motion of the ship and pipe or casing extending downwardly into the sea from the vessel, and can indeed be dangerous.

SUMMARY OF THE INVENTION

It is a major object of the invention to provide method and apparatus to overcome the described problem. Basically, the invention is employed in combination with a floating vessel (drill ship or semi-submersible vessel) having an upper portion with heavy equipment mounted thereon. The invention includes:

(a) means for anchoring the vessel at a selected site on a body of water, (b) said means including anchor lines effectively attached to the vessel and also extending away from the vessel to transfer loading to the vessel at upper and lower locations associated with the vessel and spaced from the vessel center, characterized in that tilting of the vessel is resisted by said lines.

As will be seen the lines include:

(i) a first plurality of lines extending away from said upper locations associated with the vessel, and (ii) a second plurality of lines extending away from said lower locations associated with the vessel.

The construction is such as to provide forces at different levels acting to maintain the vessel upright during adverse wind and wave conditions such as would tend to topple the vessel when restrained in a conventional manner.

These and other objects and advantages of the invention, as well as the details of an illustrative embodiment, will be more fully understood from the following description and drawings, in which:

DRAWING DESCRIPTION

FIG. 1 is a plan view of a drill ship floating on a calm body of water, with no unbalanced horizontal forces acting on the ship, and with anchor lines extending from the ship;

FIG. 2 is a view like FIG. 1, but showing two modified anchor lines;

FIG. 3 is another view like FIG. 1, but showing further modified anchor lines;

Figure 4A:
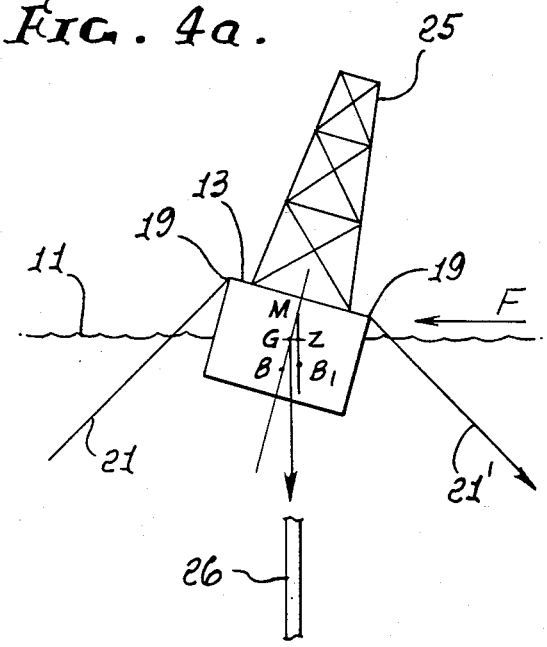
FIG. 4 is a transverse elevation, taken in section on lines 4—4 of FIG. 1.
Figure 5:
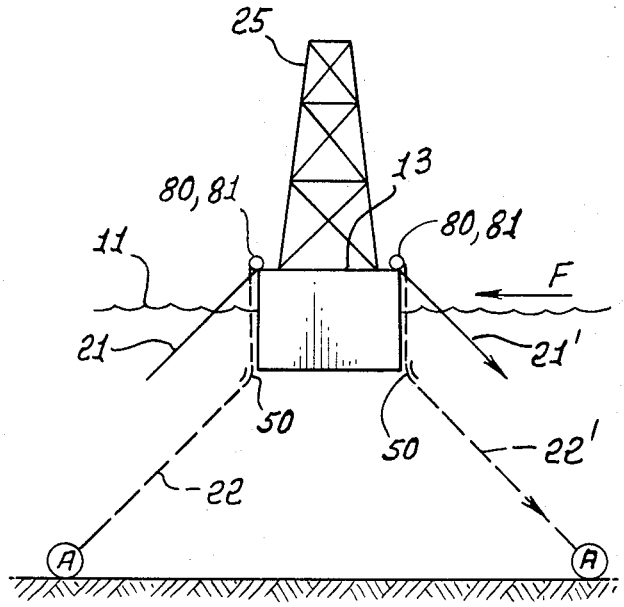
Figure 4:
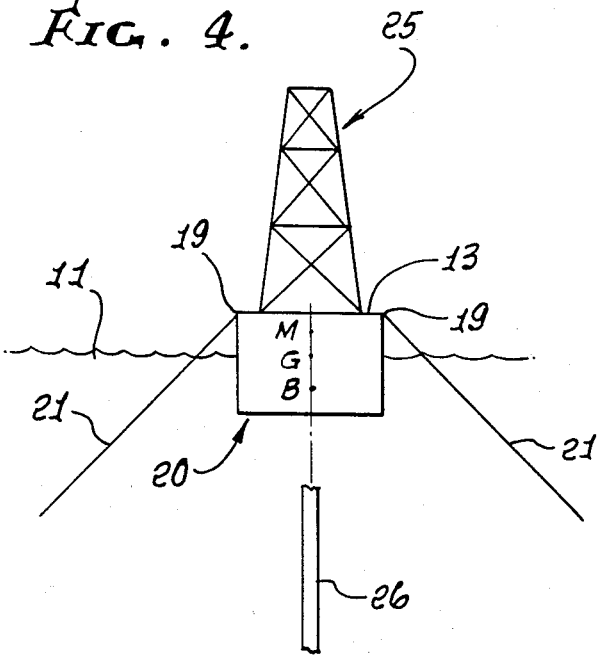
Figure 6:
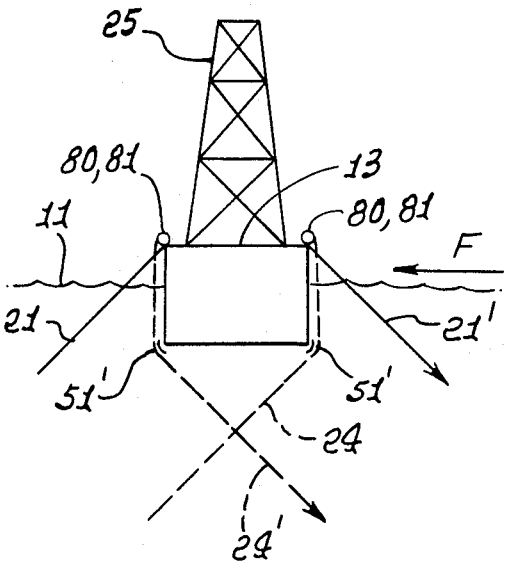
Figure 7:
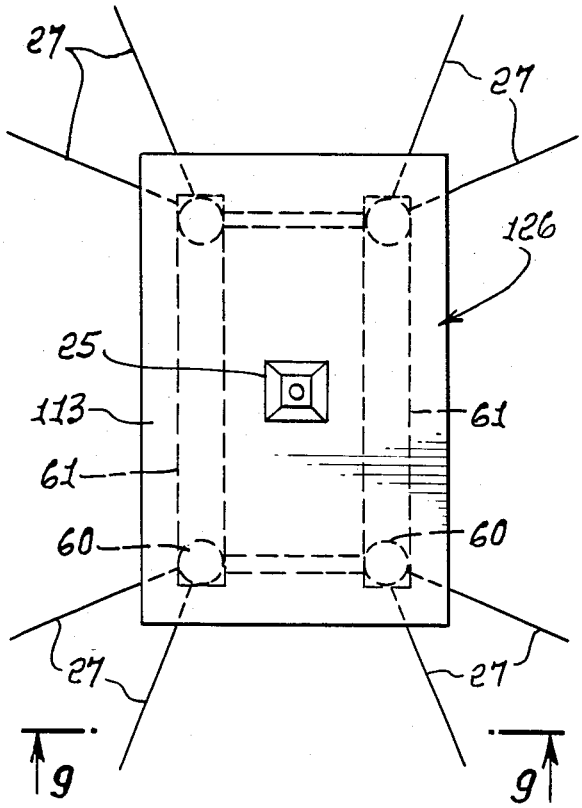
Figure 8:
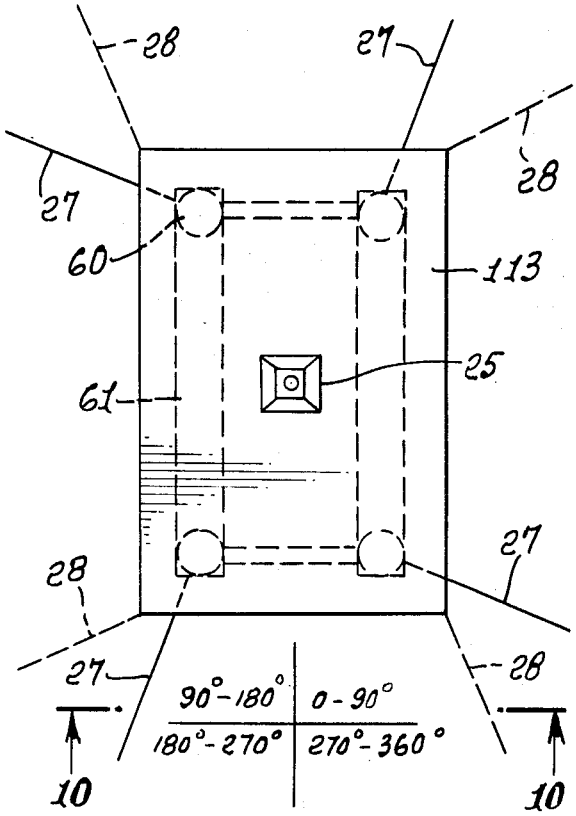
Figure 9:
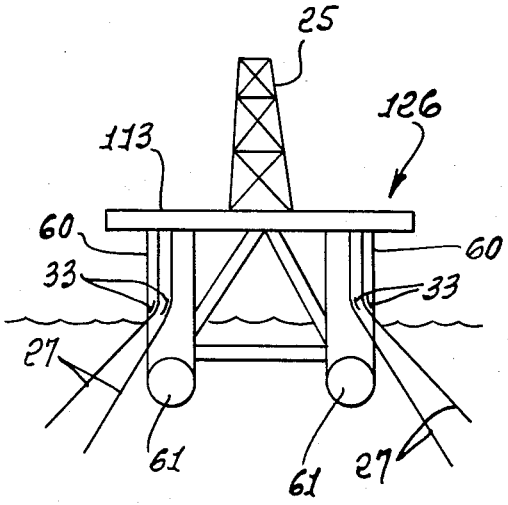
Figure 10:
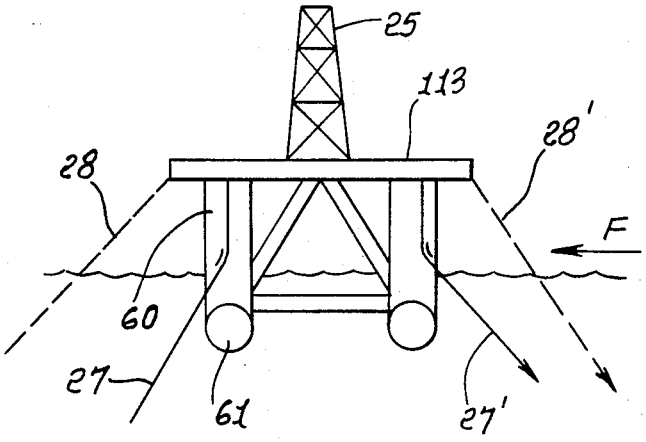
Figure 12:
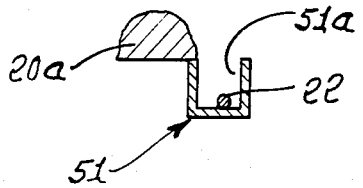
Figure 11:
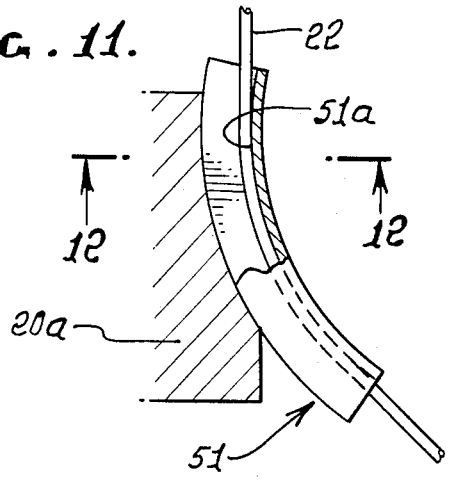
Figure 13:
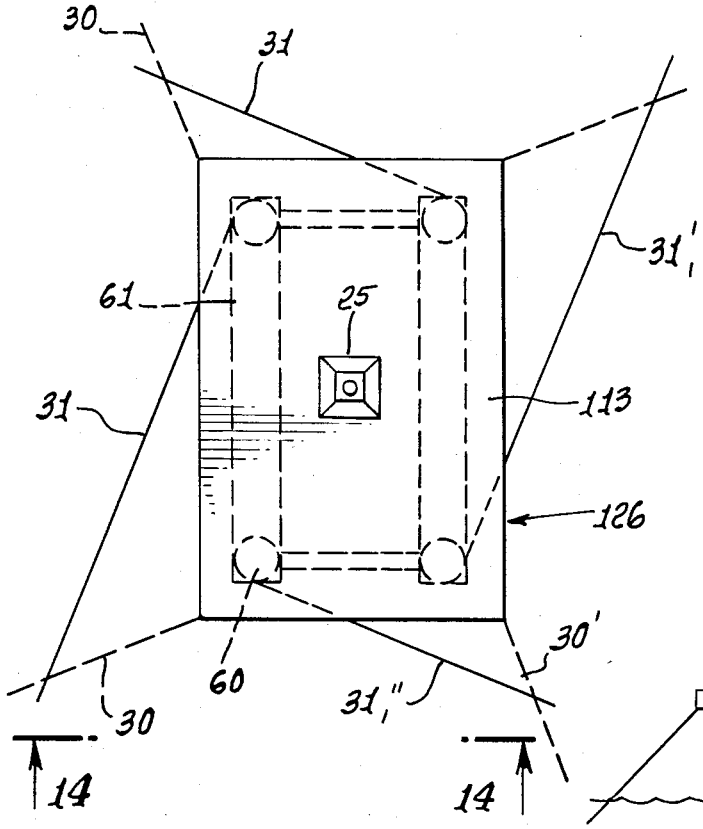
Figure 5A:
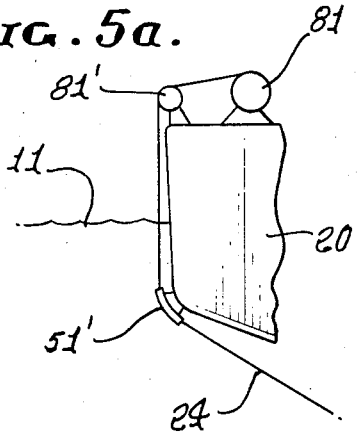
Figure 14:
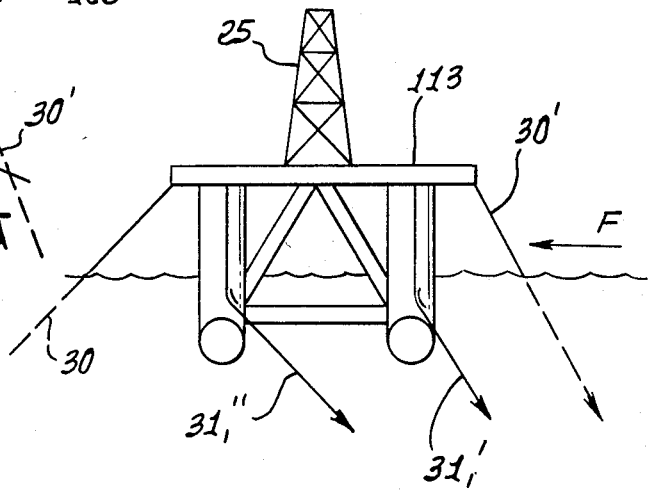

FIG. 4*a* is a view like FIG. 4, but showing rolling of the vessel during adverse wind and wave conditions;

FIG. 5 is an elevation taken in section on lines 5—5 of FIG. 2;

FIG. 5*a* is a fragmentary elevation;

FIG. 6 is an elevation taken in section on lines 6—6 of FIG. 3;

FIG. 7 is a plan view of a semi-submersible vessel, at anchor, with horizontal restraint imposed at one level on the vessel;

FIG. 8 is a view like FIG. 7, showing anchor lines providing horizontal restraint at two different levels;

FIG. 9 is an end elevation taken on lines 9—9 of FIG. 7;

FIG. 10 is an end elevation taken on lines 10—10 of FIG. 8;

FIG. 11 is an enlarged elevation showing a means for changing the direction of an anchor line;

FIG. 12 is a section on lines 12—12 of FIG. 11;

FIG. 13 is a plan view, like FIG. 8, of a submersible vessel, showing modified anchor lines providing horizontal restraint at two different levels; and FIG. 14 is an end elevation taken on lines 14—14 of FIG. 13.

DETAILED DESCRIPTION

FIGS. 1 and FIG. 4 show a drill ship 20 anchored on a calm body 11 of water with no unbalanced horizontal forces acting on the ship. Buoyant forces, acting vertically upward through B, the center of buoyancy, and gravity forces acting vertically downward through G, the center of gravity, are in equilibrium and are in a common vertical line. A derrick used during drilling appears at 25, and drill pipe or casing at 26. A moon well to pass the pipe is shown at 18.

As the drill ship is acted upon by a lateral force, F, such as may be created by wind or waves, as indicated from right to left, the drill ship will become inclined, as shown in FIG. 4*a*. The external form of the portion of the drill ship below the water line now be different and the center of buoyancy will move to another location such as $B_1$. The location of the center of gravity will be unchanged if the cargo is properly restrained. Conventionally, the anchor lines that prevent or reduce translational movement are attached to the drill ship at approximately the same elevation, usually at or in the vicinity of the deck 13 as indicated on FIG. 1 and FIG. 4. See attachment locations 19. Thus the horizontal component restraining forces are applied in essentially one plane shown as the plane of deck 13, in FIG. 4. The horizontal forces, F, applied on the drill ship, such as are caused by wind or wave action, will very rarely be in the same horizontal plane as the horizontal component restraining forces imposed via the anchor lines. Anchor line 21' in FIG. 4*a*, becomes active in resisting the horizontal force, F. Therefore, an unbalanced moment is created because of the lever arm between the horizontal forces and the horizontal component restraining forces. In order that this unbalanced moment be resisted, a similar moment but in the opposite direction must be provided. In this case the unbalanced moment created by wind and wave action is clockwise, so that, for stability, a counter-clockwise moment must be provided. The product of the lever arm, GZ, multiplied by the buoyancy acting via new location of $B_1$ provides the necessary counter-clockwise moment.

Thus it is seen that in order to provide stability against lateral loads parallel to the transverse axis of the drill ship, a rolling motion around the longitudinal axis of the drill ship is created. This method of providing the required counterclockwise moment is seen to be undesirable, because it induces rolling motion of the vessel. When the vessel rolls it acquires an angular velocity and the momentum causes it to swing beyond the position of equilibrium. Thus the vessel oscillates somewhat in the manner of a pendulum. If the period of wave action and the period of oscillation of the vessel are the same or similar they can interact so as to create an addition to the rolling motion of the vessel and, if successive interactions do occur, a dangerous condition can develop that is a hazard to safety and interferes with efficient operation of the vessel.

At present and summarizing, dissimilar support systems are used to resist the horizontal forces and the related unbalanced moments. The horizontal forces per se are resisted by the anchor lines directly; however, the unbalanced moments created by the moment arm between the horizontal forces and the restraining anchor lines must be resisted by a righting moment which is provided by the product of GZ multiplied by the buoyancy. In the first case, (horizontal force) the resulting motion of the vessel is caused by the stretching of the anchor lines plus the change in shape of the catenary curves of the anchor lines. In the second case (unbalanced moments) the resulting motion of the vessel is a rolling motion of the vessel which creates the lever arm, GZ. In the first case, the supporting system is relatively stiff or rigid. In the second case, the supporting system is relatively flexible and yielding.

In accordance with the invention, means for anchoring a floating vessel (for example drill ship or semi-submersible vessel) at a selected site on a body of water includes anchor lines; however, the anchor lines are effectively attached to the vessel and extend away from the vessel in such a way as to transfer loading to the vessel at both upper and lower locations associated with the vessel and spaced from the vessel center; further, the load transfer upper and lower locations are characterized in that tilting of the vessel is resisted by the lines, whereby the vessel remains generally vertically upright, i.e. untilted during variable wind and wave loading on the vessel.

A first plurality of anchor lines is attached to the vessel at, or in the vicinity of, the deck these anchor lines extending downwardly and away from the vessel to anchors; a second plurality of anchor lines is attached to the vessel at, or in the vicinity of, the deck, these anchor lines extending downwardly and outside of the exterior surface of the vessel to means for changing the directions of the second plurality of anchor lines and this means being attached to the vessel at, or in the vicinity of, the bottom of the vessel, the anchor lines continuing to anchors. (FIGS. 2, 3, 5 and 6). The means for changing the directions of the second plurality of anchor lines may be a device such as a roller, pulley or sheave or a curved guide such as is seen in FIG. 11.

In FIGS. 2 and 5, anchor lines 21 are the same as in FIGS. 1 and 4; however, two of the anchor lines, designated at 22, and shown as dashed lines, extend away from the lower locations 50 at, and associated with, lower underwater locations of the vessel. More specifically, the lines 22 extend downwardly from deck (and winch locations 80) to the locations 50, and then laterally and downwardly away from opposite sides of the vessel for attachment to anchors, designated at A, for example. Lines 21 also extend from deck winches 81 to anchors.

The upper ends of the anchor lines 22 are attached to and spooled around drums or winches 81 seen in FIG. 5*a*, and which can be operated so as to provide the desired tension in the anchor lines. The winches are attached to the deck or upper portion of the vessel at locations around the vessel periphery as desired. Thus the upper ends of the anchor lines are indirectly attached to the vessel via the winches. References herein to attachment of the anchor lines to the vessel will mean attachment as via the winches as described above, or by other adjustable means. Anchor lines 21 and 24 also connect to winches. See also sheave 81'.

At the lower location 50, anchor line guides 51 may be provided, to turn the anchor lines 22 away from the vessel, as shown. Such guides are attached to the vessel at lower locations 50, and FIG. 11 shows one such guide as defining a line receiving channel 51*a* that curves downwardly and laterally. Note vessel structure 20*a* to which the guide is attached.

A first plurality of lines 21 is attached to the vessel, as for example its deck 13, and such lines extend directly laterally away from upper or first locations at the deck, as in FIGS. 4 and 5. Such lines may be attached to winches, such as shown at 81 in FIG. 5*b*. See also sheaves 81' and curved guides 51'.

Note in FIG. 2 that there are two lower lines 22 extending away from opposite sides of the vessel, at angles $\alpha$ as shown; that there are two of the upper lines 21 extending away from opposite sides of the vessel, at angles $\alpha$ as shown and near the opposite end of the vessel; and that there are four upper lines 21 extending away from opposite ends of the vessel as from four corners thereof, and in different quadrants. Angles $\alpha$ are not necessarily equal, and the number and pattern of anchor lines may vary.

Thus, the first plurality of anchor lines have horizontal component restraining forces that are applied to the vessel at, or in the vicinity of, the deck, and the second plurality of anchor lines provide horizontal component restraining forces that are applied to the vessel at or in the vicinity of the bottom of the vessel. When the horizontal force, F, is applied on the vessel, anchor lines 21 and 22 become active in resisting force F and are indicated as anchor lines 21' and 22', in FIG. 5. If the force F is reversed in direction, i.e. to act from left to right, then the anchor lines 21 and 22 that would become active would be reversed also so as to resist force F. The total of the horizontal forces, such as may be caused by wind and wave action, may be considered as an equivalent composite force. The location of this equivalent composite force will herein be referred to as the centroid.

The first plurality of anchor lines and the means for changing the direction of the second plurality of anchor lines will be located and attached to the vessel in a manner so that this centroid will be located between the level of the horizontal component restraining forces created by the first plurality of anchor lines and the horizontal component restraining forces created by the second plurality of anchor lines. The horizontal component restraining forces placed at two levels in this manner will prevent the oscillatory rolling motion of the vessel described above. The vessel will therefore act in the manner of a vertical beam to resist forces such as those caused by wind and wave action. Unbalanced moments on the vessel are therefore reduced or avoided and rolling motion on the vessel is minimized.

The herein described method and apparatus interrupts the interaction between the period of oscillation of the vessel and the wave period described above, because it prevents the addition of rolling motion to the vessel. At least one of the anchor lines provides a restraining force which will oppose the additive force which would create additional rolling motion. Also it removes the requirement that the vessel roll so as to create a lever arm, GZ, which, multiplied by the buoyancy, will provide the righting moment to stabilized the vessel.

An alternative method is to attach the second plurality of anchor lines to the vessel in such manner that at least one of the horizontal component restraining forces will be applied on the vessel on the leeward side or portion of the vessel at, or in the vicinity of, the bottom of the vessel and act in a direction toward the windward side of the vessel, as shown for example in FIGS. 3 and 6.

When the horizontal force, F, is applied to the vessel as shown, anchor lines 21 and 24 become active in resisting force F and are indicated as anchor lines 21' and 24'. If the force F is reversed in direction, i.e. to act from left to right, then the anchor lines 21 and 24 that would become active would be reversed also so as to resist force F. All of the anchor lines extend downwardly as they continue from the vessel to the anchors. Additional anchor lines 22 or 24 may be used if desired.

As before, the first plurality of anchor lines 21 and the means 51' (such as curved guides attached to lower locations on the vessel to turn lines 24 under and below the vessel in opposite directions) for changing the direction of the second plurality of anchor lines 24 will be located and attached to the vessel in a manner so that the centroid of the horizontal forces will be located between the level of the horizontal component restraining forces created by the first plurality of anchor lines and the horizontal component restraining forces created by the second plurality of anchor lines. Thus a greater moment arm is provided between the first plurality of anchor lines and the second plurality of anchor lines than can otherwise be obtained. In this manner unbalanced moments that may be caused by such forces as wind or wave action are resisted in a very effective manner and rolling motion of the vessel is minimized.

Another method frequently used where buoyant vessels are used to support a derrick and derrick floor for drilling operations over a body of water, is to mount the derrick and derrick floor on a tubular framework as at 60 in FIGS. 7 and 9, which framework is in turn supported by partially or wholly submerged buoyant members 61. The tubular framework is of relatively open type of construction which reduces horizontal loading from wind and wave action. Also the deck is located well above sea level. Vessels of this type shown at 126 in FIGS. 7 and 9 are of various shapes and dimensions but are classified as semisubmersibles. Anchor lines as shown at 27 are attached to these vessels in such manner as to provide horizontal restraint acting at essentially one level but not necessarily at the deck level. Curved guides 33 at the same level turn the lines 27 away from the vessel. When horizontal forces, such as wind or wave loads, are applied to the vessel, an unbalanced moment is thereby created in a manner somewhat similar to the moment applied to the drill ship 2Q described above. In order to provide stability, a counterbalancing moment must be provided by means of a shift in the location of the center of buoyancy, as in the case of the drill ship.

It is clear that the same causes that produce rolling motion of the drill ship also produce rolling motion of the semi-submersible vessel. Also the same corrective measures that are effective in minimizing rolling motion of the drill ship will be effective in minimizing rolling motion of the semi-submersible. The anchor lines are arranged to provide horizontal component restraining forces applied by a first plurality of anchor lines 28 at, or in the vicinity of, the deck 113; and by providing additional horizontal component restraining forces by a second plurality of anchor lines 27 at, or in the vicinity of, the bottom portion of the vessel, as for example is shown in FIGS. 8 and 10. Accordingly, some portions of the semi-submersible vessel act as a vertical beam or beams to resist forces such as those caused by wind or wave action. Unbalanced moments are therefore reduced or avoided and rolling motion of the vessel is minimized.

As in the case of the drill ship, the total of the horizontal forces, such as may be caused by wind and wave action, may be considered as an equivalent composite force applied at the centroid of these horizontal forces. The location of this centroid may move in accordance with the type and intensity of the adverse weather conditions that cause the wind and wave action.

The location of the centroid will rise particularly under conditions of adverse weather. The first plurality of anchor lines and the means for changing the direction of the second plurality of anchor lines will be located and attached to the vessel in a manner so that during adverse weather conditions the centroid of the resulting horizontal forces will be located between the level of the horizontal component restraining forces created by the first plurality of anchor lines and the level of the horizontal component restraining forces created by the second plurality of anchor lines.

The first plurality of anchor lines may be attached to the vessel at the deck or to an upper portion of some of the vertical tubular framework members, and the means for changing the directions of the anchor lines of the second plurality of anchor lines may be attached to lower portions of some of the vertical tubular framework members or to a submerged buoyant member.

In FIG. 10, when the horizontal force, F, is applied on the vessel from right to left, certain of the anchor lines 27 and 28 become active in resisting force F and are indicated as anchor lines 27' and 28'. If the force F is changed in direction, then the anchor lines 27 and 28 that would become active would change correspondingly so as to resist force F. To this end, the anchor lines 27 and 28 alternate, about the vessel, as shown in FIG. 8, and there are four of each, with pairs extending in each of indicated four quadrants 0°–90°, 90°–180°, 180°–270° and 270°–360°.

Similarly, as shown in FIGS. 13 and 14, when the horizontal force, F, is applied on the vessel, certain of the anchor lines 30 and 31 become active in resisting force F and are indicated as anchor lines 30', $31_1'$ and $31_1''$. Anchor lines 31 are attached to the vessel in such manner that at least one of these anchor lines can provide a horizontal component restraining force on a leeward lower portion of the vessel as indicated by $31_1''$, FIG. 14. If the force F is changed in direction, then the anchor lines 30 and 31 that would become active would change correspondingly so as to resist force F.

The semi-submersible vessel, by the nature of its construction, has a relatively high center of gravity. With an anchoring system that provides horizontal component restraining forces at only one level, which is the present practice, the vessel has a relatively low stability when it its subjected to horizontal forces, such as those caused by wind and wave action. The usage of the anchoring system proposed by this invention improves the stability characteristics of the semi-submersible.

The semi-submersible has a relatively large deck 113 mounted on the vessel at a high elevation above the calm water level. During adverse weather, horizontal forces, such as may be caused by wind or wave action, may cause the vessel to list or incline. When this occurs, the tilting of the deck will expose additional surface area to wind loads. The effect of the inclined deck on the vessel is somewhat similar to a sail. Thus additional tilting will occur and the cycle can continue until the vessel is endangered. Anchor lines attached to the vessel in such manner as to provide horizontal component restraining forces at one level only, which is the conventional method being used at present, cannot prevent tilting or inclining of the vessel.

The present invention provides anchor lines attached to the vessel in such manner as to provide horizontal component restraining forces at two levels. This makes it possible to force the vessel to float in a manner so that tilting or rolling motion will be minimized.

In the drawings, the levels of the horizontal component restraining forces created by the second plurality of such anchor lines are the levels of the line turning devices 51, 51' and 33.

The means 51 may take other forms, such as rollers or sheaves, and they represent means to change the directions of the anchor lines. The same applies to 51' and 33.

In FIG. 8, combinations of anchor lines attached to upper and lower levels of the vessel and different subdivisions of the perimeter of the vessel may be used without departing from the spirit of the invention.

The invention also extends to the method of stabilizing a floating vessel as described. The method includes the steps:

(a) attaching the anchor lines to the vessel to extend away from the vessel for transferring loading to the vessel at upper and lower locations associated with the vessel and spaced from the vessel center, (b) and adjusting said lines so that tilting of the vessel is resisted by said lines.

Such adjustment is typically carried out to displace at least one of the anchor lines relative to the lower locations (as for example the curved guide) at which it transfers loading to the vessel; and typically the adjustment is effected at winches located on a deck above such lower locations.

Further, the lines may include (i) a first plurality of lines extending away from said upper locations associated with the vessel, and (ii) a second plurality of lines extending away from said lower locations associated with the vessel, and both groups of lines are typically adjusted to maintain the vessel in upright condition, resisting tilting due to wind and wave action.

In the case of the present application, the means for resisting horizontal forces per se on the vessel, and the means for resisting unbalanced moments, are compatible.

I claim:

1. In combination with a floating vessel having an upper portion with heavy equipment mounted thereon, (a) means for anchoring the vessel at a selected site on a body of water, (b) said means including first and second pluralities of anchor lines effectively attached to the vessel and also extending away from the vessel to transfer loading to the vessel at upper and lower locations respectively, said locations associated with the vessel and spaced from the vessel center characterized in that tilting of the vessel is resisted by said lines, said upper locations being above water body surface level, and said lower locations being below water body surface level, each anchor line extending separately and individually to an individual anchor, each of said first and second plurality of anchor lines extending to anchors in initial directions relative to the sides and ends of the vessel, and always maintained in said initial directions relative to the vessel sides and ends during wind and wave force impingement on the vessel during a storm and to resist said wind and wave forces acting from any direction relative to the sides and ends of the vessel, some of said anchor lines extending to areas aft of and in front of the vessel.

2. In combination with a floating vessel having an upper portion with heavy equipment mounted thereon, (a) means for anchoring the vessel at a selected site on a body of water, (b) said means including anchor lines effectively attached to the vessel and also extending away from the vessel to transfer loading to the vessel at upper and lower locations associated with the vessel and spaced from the vessel center characterized in that tilting of the vessel is resisted by said lines, said upper locations being above water body surface level, and said lower locations being below water body surface level, each anchor line extending to an anchor, (c) said lines including (i) a first plurality of lines extending away from said upper locations associated with the vessel, and (ii) a second plurality of lines extending away from said lower locations associated with the vessel, (iii) the vessel having opposite sides and opposite ends, said upper locations including locations at said opposite sides of the vessel which are proximate said opposite ends thereof, (iv) and said lower locations including locations at said opposite sides of the vessel which are proximate said opposite ends thereof, (v) each of said first and second plurality of lines extending directionally generally sidewise and endwise relative to opposite sides and ends of the vessel, and maintained in said directions and relative to the vessel sides and ends during wind and wave action during a storm, the anchors for some of the lines being located in positions such that the lines thereto extend directionally toward regions forward and aft of the vessel.

3. The combination of claim 2 wherein one of said first and second pluralities of lines includes more of said lines than the other of said first and second pluralities of lines.

4. The combination of claim 2 wherein said first plurality of lines includes more lines than the second plurality of lines.

5. The combination of one of claims 1–4 wherein all of said lines extend to upper locations associated with the vessel.

6. The combination of one of claims 1–4 wherein all of said lines extend to vessel deck locations.

7. The combination of one of claims 1–4 wherein all of said lines extend to winches on the vessel, and which are above water level.

8. The combination of claim 2 wherein the second plurality of lines extends from winching locations on the vessel above water level to other locations associated with the vessel below water level, and then away from the vessel.

9. The combination of claim 8 wherein said other locations are defined by anchor line guides which turn the lines relative to the vessel, said guides attached to the vessel.

10. The combination of claim 9 wherein the guides are curved to turn the lines away from the underside of the vessel.

11. The combination of claim 9 wherein the guides are reversed to turn the lines beneath the vessel.

12. The combination of one of claims 1–4 and 8–11, wherein said vessel is of semi-submersible construction, having underwater portions.

13. The combination of one of claims 1–4 and 8–11 wherein said vessel comprises a drill ship having a vertical moon well through opening for passing a drill string.

14. The combination of claim 2 wherein the vessel is of semi-submersible construction, and pairs of the upper and lower lines extending in each of the four quadrants 0°–90°, 90°–180°, 180°–270°, and 270°–360°.

15. In combination, a floating vessel with a deck and well-drilling derrick mounted thereon having means for anchoring the vessel at a specific location on a body of water including a first plurality of anchor lines attached to the vessel at, or in the vicinity, of the deck, said anchor lines extending from first locations at the vessel downwardly and away from the vessel to anchors; a second plurality of anchor lines attached to the vessel at, or in the vicinity of, the deck, these anchor lines extending downwardly near the vessel to means at second locations for changing the directions of the second plurality of anchor lines, said means being attached to the vessel at, or near the bottom or bottom portion of the vessel, the anchor lines continuing to anchors, said first and second pluralities of anchor lines acting in cooperation characterized in that tilting of the vessel is resisted by said lines, each of said first and second plurality of anchor lines extending to anchors in initial directions relative to the sides and ends of the vessel, and always maintained in said initial directions relative to the vessel sides and ends during wind and wave force impingement on the vessel during a storm and to resist said wind and wave forces acting from any direction relative to the sides and ends of the vessel, some of said anchor lines extending to areas aft of and in front of the vessel.

16. The combination, a floating vessel with a deck and well-drilling derrick mounted thereon having means for anchoring the vessel at a specific location on a body of water including a first plurality of anchor lines attached to windward portions of the vessel at upper levels at, or in the vicinity of the deck, said anchor lines extending downwardly and away from the vessel to anchors; a second plurality of anchor lines at least one of which is attached to a leeward portion of the vessel at, or in the vicinity of, the deck, these anchor lines extending downwardly to means at lower levels for changing the directions of the second plurality of anchor lines and at least one of such means for changing the direction of these anchor lines being attached to a leeward lower portion of the vessel at, or near the bottom of the vessel, said anchor lines continuing on to anchors in such manner as to create a horizontal component restraining force on the vessel in the direction toward the windward side of the vessel, said upper levels being above mean sea level, and said lower levels being below mean sea level, each of said first and second plurality of anchor lines extending to anchors in initial directions relative to the sides and ends of the vessel, and always maintained in said initial directions relative to the vessel sides and ends during wind and wave force impingement on the vessel during a storm and to resist said wind and wave forces acting from any direction relative to the sides and ends of the vessel, some of said anchor lines extending to areas aft of and in front of the vessel.

17. In combination, a floating vessel with a deck and well-drilling derrick mounted thereon having means for anchoring the vessel at a specific location on a body of water including a first plurality of anchor lines, including lines attached to the vessel to extend from windward portions of the vessel at, or in the vicinity of the deck, said anchor lines extending downwardly and away from the vessel to anchors in such manner as to create horizontal components of restraining force on the windward upper portion of the vessel in the direction from which the wind blows; and a second plurality of anchor lines including lines attached to the vessel at, or in the vicinity of, the deck, and extending downwardly to means at or in the vicinity of the bottom of the vessel, and continuing to anchors in such manner as to create horizontal components of restraining force of the leeward lower portion of the vessel in the direction toward the windward side of the vessel, said upper levels being above mean sea level, and said lower level being below mean sea level, each of said first and second plurality of lines including lines extending in positions generally sidewise relatively away from opposite sides of the vessel and lines extending in positions generally endwise relatively away from opposite ends of the vessel, and maintained in said positions and relative to the vessel sides and ends during wind and wave exertion on the vessel during a storm, the anchors for some of the second plurality of lines being located aft of and forward of the vessel.

18. In combination, a floating vessel with a deck and well-drilling derrick mounted thereon having means for anchoring the vessel at a specific location on a body of water including a first plurality of anchor lines attached to an upper level of the vessel at, or in the vicinity of the deck, said anchor lines continuing downwardly and away from the vessel to anchors; and a second plurality of anchor lines attached to the vessel at, or in the vicinity of the deck and extending downwardly to means for changing the directions of these anchor lines located at a lower level of the vessel and continuing to anchors, the upper level attachment points of said first plurality of anchor lines and the lower level attachment points of the means for changing the directions of the second plurality of anchor lines being located such that the centroid of horizontal forces produced in adverse weather conditions by wind and wave action above mean sea level will be located at a level between said upper level attachment points for the first plurality of anchor lines and the lower level attachment points for the means for changing the directions of the second plurality of anchor lines, said upper level being above mean sea level, and lower level being below mean sea level, each of said first and second plurality of anchor lines extending to anchors in initial directions relative to the sides and ends of the vessel, and always maintained in said initial directions relative to the vessel sides and ends during wind and wave force impingement on the vessel during a storm and to resist said wind and wave forces acting from any direction relative to the sides and ends of the vessel, some of said anchor lines extending to areas aft of and in front of the vessel.

19. In combination, a floating vessel with a deck and well-drilling derrick mounted thereon having means for anchoring the vessel at a specific location on a body of water including a first plurality of anchor lines attached to an upper level of the vessel at, or in the vicinity of the deck, said anchor lines continuing downwardly and away from the vessel to anchors, and a second plurality of anchor lines attached to the vessel at, or in the vicinity of the deck, and extending downwardly to means for changing the directions of these anchor lines located at a lower level of the vessel and then extending to anchors, the first plurality of anchor lines and the means for changing the directions of the second plurality of anchor lines being located and attached to the vessel in a manner so that the centroid of horizontal forces such as those produced by wind and wave action under conditions of adverse weather will be located at a level between the level of the horizontal component restraining forces created by the first plurality of anchor lines and the level of the horizontal component restraining forces created by the second plurality of anchor lines, said upper level being above mean sea level, and said lower level being below mean sea level, each of said first and second plurality of anchor lines extending to anchors in initial directions relative to the sides and ends of the vessel, and always maintained in said initial directions relative to the vessel sides and ends during wind and wave force impingement on the vessel during a storm and to resist said wind and wave forces acting from any direction relative to the sides and ends of the vessel, some of said anchor lines extending to areas aft of and in front of the vessel.

20. In the method of stabilizing a floating vessel having an upper portion with heavy equipment mounted thereon and means for anchoring the vessel at a a selected site on a body of water, said means including anchor lines, the steps that include:

(a) attaching the anchor lines to the vessel to extend away from the vessel for transferring loading to the vessel at upper and lower locations associated with the vessel and spaced from the vessel center, said upper locations being above water body surface level, and said lower locations being below water body surface level, each anchor line extending separately and individually to an individual anchor, (b) and adjusting said lines so that tilting of the vessel is resisted by said lines, (c) there being a first plurality of said lines extending from the vessel at said upper locations, and a second plurality of said lines extending from the vessel at said lower locations, said attachment carried out to cause said first and second pluralities of lines to extend directionally sidewise and endwise relative to opposite sides and ends of the vessel and toward regions fore and aft of the vessel, and including maintaining said lines to extend in said directions during wind and wave action during a storm, the anchors for some of the lines being located aft of and forward of the vessel.

21. The method of claim 20 wherein said adjustment is carried out to displace at least one of said lines relative to the lower location at which it transfers loading to the vessel.

22. The method of one of claims 20 and 21 wherein said adjustment is carried out at locations above said lower locations.

23. The method of claim 20 wherein said lines include (i) a first plurality of lines extending away from said upper locations associated with the vessel, and (ii) a second plurality of lines extending away from said lower locations associated with the vessel, said (b) adjustment step being carried out to adjust lines of both groups (i) and (ii).

* * * * *